United States Patent [19]

Steiner

[11] Patent Number: 4,614,209

[45] Date of Patent: Sep. 30, 1986

[54] WEAVING ROTOR FOR MULTIPLE LONGITUDINAL TRAVERSING SHED WEAVING MACHINES

[75] Inventor: Alois Steiner, Rieden, Switzerland

[73] Assignee: Sulzer-Rüti Machinery Works Limited, Rüti, Switzerland

[21] Appl. No.: 657,351

[22] Filed: Oct. 3, 1984

[30] Foreign Application Priority Data

Oct. 12, 1983 [EP] European Pat. Off. ..... 83110168.8

[51] Int. Cl.[4] ..... D03D 47/00

[52] U.S. Cl. ..... 139/11

[58] Field of Search ..... 39/11, 11 A, 28

[56] References Cited

U.S. PATENT DOCUMENTS 3,848,642 11/1974 Steiner ..... 139/11 A 4,498,501 2/1985 Steiner ..... 139/28

*Primary Examiner*—Henry S. Jaudon

*Attorney, Agent, or Firm*—Werner W. Kleeman

[57] ABSTRACT

In a weaving rotor of a multiple longitudinal traversing shed weaving machine a beat-up lamella of a first beating-up comb lies in a plane extending substantially perpendicular to the rotational axis of the rotor and centrally between two beat-up lamellae of a next following beating-up comb. The greater division or pitch of these beat-up lamellae permits a faultless insertion of the weft threads into the lanes or intermediate spaces of the shed-forming combs. Nevertheless, when considered with regard to two subsequent beat-up operations, each weft thread is practically beat-up as if each beating-up comb were equipped with the full number of lamellae.

1 Claim, 1 Drawing Figure

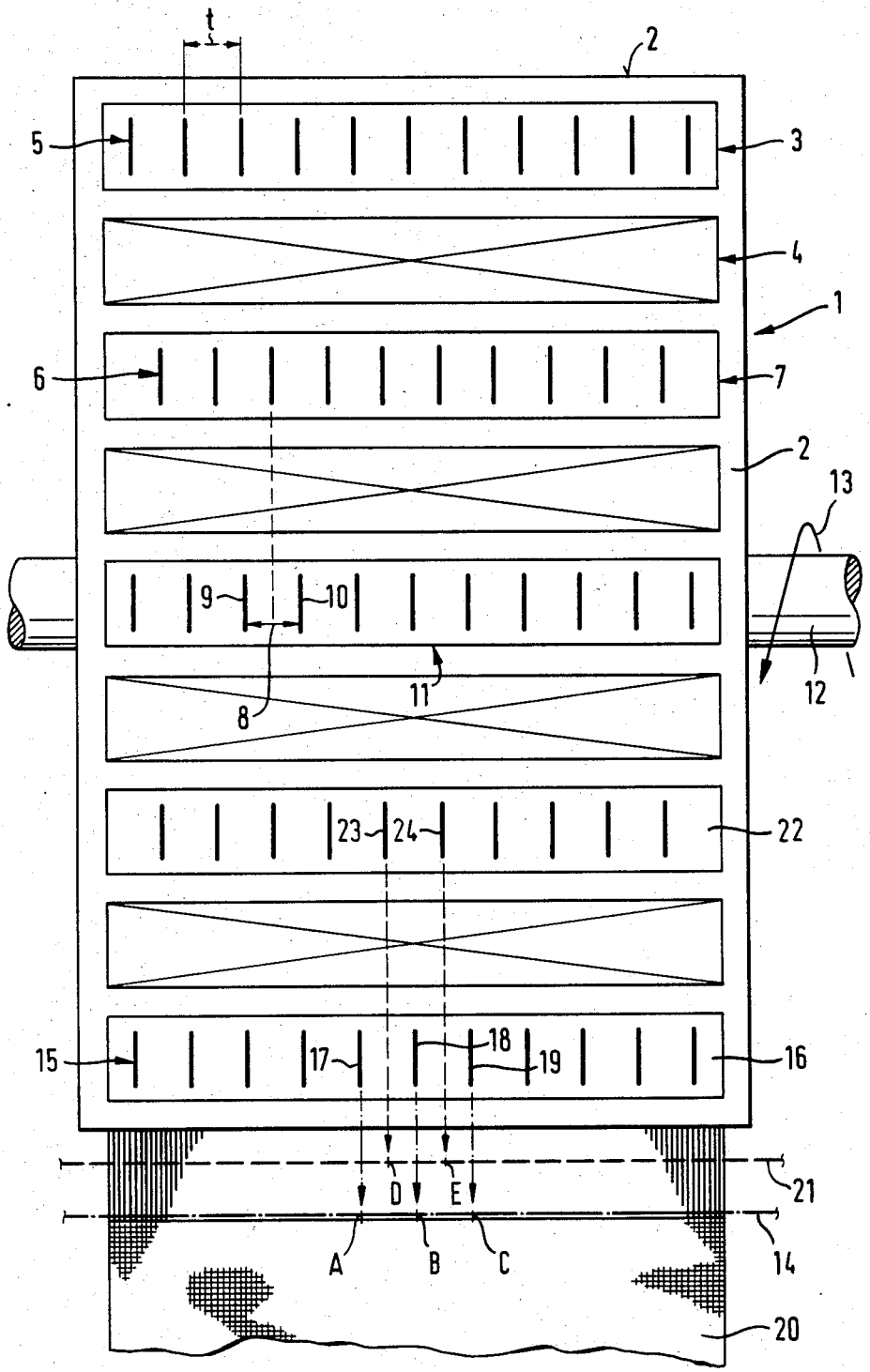
t
2
5
3
4
1
6
7
2
13
9
10
11
12
8
22
23
24
15
17
18
19
16
21
D
E
A
B
C
14
20

WEAVING ROTOR FOR MULTIPLE LONGITUDINAL TRAVERSING SHED WEAVING MACHINES

BACKGROUND OF THE INVENTION

The present invention broadly relates to weaving machines and, more specifically, pertains to a new and improved construction of a weaving rotor for a multiple longitudinal traversing shed weaving machine having beating-up lamellae combs for the warp threads.

In a known weaving rotor of this type (cf. Swiss Pat. No. 633,590, granted Dec. 15, 1982 and the corresponding U.S. Pat. No. 4,290,458, granted Sept. 22, 1981), the beating-up lamella combs and the shed-forming lamella combs are mutually shifted by a half-lamella division. The individual warp threads are controllably inserted into the intermediate space or lane—also known as tubes—formed by the lamellae of the shed-forming combs. Faulty insertion of the warp threads leads to warp stripes or weave faults. The greater the warp density, i.e. the greater the number of warp threads per centimeter, the more difficult it is to achieve a faultless insertion of the warp threads.

SUMMARY OF THE INVENTION

Therefore, with the foregoing in mind it is a primary object of the present invention to provide a new and improved construction of a weaving rotor which does not exhibit the aforementioned shortcomings of the prior art constructions.

Another and more specific object of the present invention aims at providing a new and improved construction of a weaving rotor of the previously mentioned type which permits a faultless insertion or drawing-in of the warp threads.

Yet a further significant object of the present invention aims at providing a new and improved construction of a weaving rotor of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the weaving rotor of the present invention is manifested by the features that, in sequential order, a lamella of a first comb is located in a plane situated centrally between two lamella of a subsequent comb.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing schematically illustrates a development view of a weaving rotor constructed according to the present invention.

DETAILED DESCRIPTION OF THE PREFERRED EMBODIMENTS

Describing now the drawings, it is to be understood that to simplify the showing thereof, only enough of the structure of the weaving rotor has been illustrated therein as is needed to enable one skilled in the art to readily understand the underlying principles and concepts of this invention. Turning now specifically to the single FIGURE of the drawing, the apparatus illustrated therein by way of example and not limitation will be seen to comprise a weaving rotor 1 alternatingly equipped in known manner at its circumference 2 with a number of beating-up combs 3 and an equal number of shed-forming combs 4. For the sake of representational clarity, only a few lamellae 5 of each beating-up or beat-up comb 3 are depicted and are each schematically represented by a line. The division or pitch t of the lamellae 5 is greater than in the known beating-up comb, so that the beating-up combs 3 contain fewer lamellae 5. The conventional lamellae of the shed-forming combs 4 are not particularly shown. As can be seen in the drawing, the beating-up combs 3 are appropriately fastened to the circumference 2 of the weaving rotor 1 so as to be shifted in relation to one another in the axial direction of this weaving rotor 1 such that the respective lamellae 5 of one beating-up comb 3 are each located in a plane extending centrally through a gap or space 8 located between two lamellae 6 of the subsequent or next following beating-up comb 3 viewed in the direction of beating-up of the inserted weft thread. Thus, each lamellae 6 of a beating-up comb 7 is situated in a respective plane extending through a gap or space 8 between two neighboring lamellae 9 and 10 of the subsequent beating-up comb 11. The weaving rotor 1 is fixed to a shaft 12 and is appropriately driven in the direction of the arrow 13.

When beating-up an inserted weft thread 14, the latter is beat-up by the beat-up lamellae 15 of the advancing beating-up comb 16. For instance, the lamellae 17, 18 and 19 of the beating-up comb 16 beat-up the weft thread 14 at their respective positions A, B and C into the cloth or fabric 20. The subsequent weft thread 21, drawn in broken line, is beat-up by the trailing beating-up comb or reed 22, that is, by a beating-up comb located just before this weft thread 21. For instance, the beat-up lamellae 23 and 24 of the beating-up comb 22 beat-up this weft thread at the positions D and E. Since the beat-up lamellae of both beating-up combs 16 and 22 are shifted with respect to one another as described, the beating-up position D lies between the beating-up positions A and B and the beating-up position E lies between the beating-up positions B and C.

It will be understood that the beating-up action effected by the trailing beating-up comb 22 acts nearly as strongly upon the already beat-up weft thread 14 as does the beating-up action of the precursive comb 16. The result is that, when regarded over two subsequent beating-up operations, each weft thread 14 is beat-up practically as if each beating-up comb or reed were equipped with the full number of beat-up lamellae. Nevertheless, a faultless insertion of the warp threads 14 into the intermediate spaces or tubes of the shed-forming combs 4 is permitted by the greater division or pitch of the beat-up lamellae.

While there are shown and described present preferred embodiments of the invention, it is to be distinctly understood that the invention is not limited thereto, but may be otherwise variously embodied and practiced within the scope of the following claims.

Accordingly, what I claim is:

1. A weaving rotor for a multiple longitudinal traversing shed weaving machine having beating-up lamellae combs for the weft threads arranged about the circumference of the weaving rotor, comprising:

a first beating-up comb equipped with beat-up lamellae;

a second beating-up comb equipped with beat-up lamellae;

said first beating-up comb trailing said second beat-up comb in a predetermined direction of rotation of the weaving rotor;

each lamella of said first beating-up comb lying in a respective plane extending substantially centrally between two neighboring lamellae of said second beating-up comb; and an alternate successive arrangement of said first and second beating-up combs being provided about the circumference of the rotor.

* * * * *